US007703642B2

(12) United States Patent
Scott

(10) Patent No.: US 7,703,642 B2
(45) Date of Patent: Apr. 27, 2010

(54) TAMPER EVIDENT CLOSURE ASSEMBLIES

(75) Inventor: Edward Sean Scott, Auckland (NZ)

(73) Assignee: Alto Holdings Limited, Auckland (NZ)

( * ) Notice: Subject to any disclaimer, the term of this patent is extended or adjusted under 35 U.S.C. 154(b) by 893 days.

(21) Appl. No.: 10/539,776

(22) PCT Filed: Dec. 19, 2003

(86) PCT No.: PCT/NZ03/00291

§ 371 (c)(1),
(2), (4) Date: Jan. 17, 2006

(87) PCT Pub. No.: WO2004/056670

PCT Pub. Date: Jul. 8, 2004

(65) Prior Publication Data

US 2006/0151418 A1 Jul. 13, 2006

(30) Foreign Application Priority Data

Dec. 20, 2002 (NZ) ..... 523373

(51) Int. Cl.
*B67D 3/00* (2006.01)

(52) U.S. Cl. ..... 222/522; 215/254

(58) Field of Classification Search ..... 222/522, 222/566–570, 80–83, 83.5, 541.2; 206/222; 215/6, 250–258; 220/521, 277, 278
See application file for complete search history.

(56) References Cited

U.S. PATENT DOCUMENTS 3,738,545 A 6/1973 Roy ..... 222/525
4,610,374 A * 9/1986 Buehler ..... 222/83
5,456,374 A * 10/1995 Beck ..... 215/251
5,680,965 A 10/1997 Beck ..... 222/153
5,927,549 A * 7/1999 Wood ..... 222/83
D419,447 S * 1/2000 Molloy ..... D9/449
6,116,445 A * 9/2000 Ikemori et al. ..... 215/301
6,257,436 B1 * 7/2001 McGlauflin ..... 220/533
6,257,463 B1 7/2001 De Polo ..... 222/525
6,321,924 B1 * 11/2001 Yurkewicz et al. ..... 215/251
6,477,743 B1 * 11/2002 Gross et al. ..... 222/525
6,659,308 B1 * 12/2003 Kelder et al. ..... 222/83
6,772,910 B1 * 8/2004 Coory ..... 222/83

FOREIGN PATENT DOCUMENTS

WO WO01/36289 5/2001
WO WO03/051734 6/2003

* cited by examiner

*Primary Examiner*—Lien T Ngo
(74) *Attorney, Agent, or Firm*—Jacobson Holman PLLC

(57) ABSTRACT

A sipper type capping assembly engageable with a necked container so as not to pool condensation on the disc seal. It has a unitary molding (1) adapted to define a detachable overcap (4) and at least the container engaging skirt (9). An insert (2) and a disc seal member (17) located within molding (1), and a nozzle component (3) above the seal member is carried through the insert yet moveable relative thereto. In a non-dispensing condition, the nozzle component (3) and the insert (2) provide closure. In the dispensing condition of the nozzle component (3) relative to the insert (2) there is defined a liquid egress passageway. The insert and the nozzle component, when in or notionally considered in the non-dispensing condition, define together with the molding a fully enclosed space about part of the nozzle component. When in or notionally considered in at least the dispensing condition, the molding and the disc seal member fully enclose the nozzle component.

9 Claims, 15 Drawing Sheets

TAMPER EVIDENT CLOSURE ASSEMBLIES

This is a nationalization of PCT/NZ03/000291 filed Dec. 19, 2003 and published in English.

FIELD OF INVENTION

The present invention relates to improvements in or relating to tamper evident closure assemblies and to related components, products, methodologies and the like.

BACKGROUND

There has been a trend towards liquid dispensing containers (hereafter "containers") of a kind having a liquid content capable of being dispensed (e.g. including by pouring, sucking and/or squeezing) reliant on a pull out or the equivalent outlet nozzle of a closure assembly.

It is usual with all such containers to provide some semblance of protection for the outlet nozzle if the container is not to be one to be filled by the purchaser himself or herself, i.e. where a container is being sold as a throwaway or a potential container for reuse.

With such a nozzle outlet assembly it is also usual for some form of seal system to be utilised to prevent contamination of the liquid content of the bottle and/or accidental or deliberate egress of liquid therefrom without evidence of tampering. Usually such a seal system involves a form of removable seal (e.g. whether of a foil, a laminate or a polycell material or otherwise (e.g. "polycell liners")). Such seals can be provided with a tab such that upon removal of, for example, a closure assembly which carries the outlet nozzle, the seal can be removed. Other forms involve a foil or other pierceable membrane capable of being broken without any removal of all of the closure assembly, i.e. it can be punched through by an appropriate manipulation of the outlet nozzle itself and/or some inner extension thereof.

Such containers usually have a neck with an external thread engageable by part of the closure assembly. The containers usually in the form of a bottle or flask and at least most components of the closure assembly are usually manufactured from a fast cycle injection plastics material such as a suitable food grade polypropylene or polyethylene. Reference herein therefore to "moulded components" preferably refers to materials of a plastics type but where appropriate such materials can be substituted by other materials (whether metal or otherwise) or other conventional materials used for cap making. Likewise, membranes as referred to herein as being used to provide a seal of the bottle itself can be of any suitable material whether adapted for tear off, piercing or otherwise.

The present invention recognises an advantage arising from a capability of defining in a preassembled form of such a tamper evident closure assembly (e.g. in a controlled environment) a space not capturing much moisture prior to association with a container, such association, particularly where there is to be a hot filling of the container, being in an environment where the container is exposed to moisture and air. In so doing the volume of moisture and air captured between any such assembly and the sealed container can be minimised.

BRIEF DESCRIPTION OF THE INVENTION

In a first aspect the present invention consists in a capping assembly engageable with or engaged with a necked container, said assembly being or having a first component in the form of a unitary moulding adapted to define a detachable overcap and at least a skirt (e.g. separated by frangible means), the skirt being adapted to engage or engaging the exterior of the neck of a suitable said container, a second component located within said first component, and a nozzle component carried through the second component yet moveable relative to the second component such that, in one relative condition, the nozzle component together with the surrounding second component, is adapted to provide closure of the mouth of a suitable said container or provides closure of the container (the "non-dispensing condition"), and in another condition of the nozzle component relative to the second component, is adapted to provide for such a suitable said container, or provides for the container, a liquid egress passageway ("the dispensing condition"), and wherein the second component and the nozzle component, when in the dispensing condition, define together with the first component a fully enclosed space about part of said nozzle component.

Preferably, said skirt of the first component is internally threaded as the adaptation to engage or the means by which it is engaged with the exterior of the neck of a suitable said container.

When used herein "when in the dispensing condition", or indeed "when in the non-dispensing condition", can include a notional condition, e.g. it may be that such a condition is not achievable without removal or rupture of the overcap and/or a seal. Accordingly, as used herein "notional" or "notionally" includes other than "actual" or "actually" yet remains a possibility albeit with some tampering in some instances.

As used herein the term "preferably" refers to an option.

As used herein "and/or" means "and" or "or".

As used herein the term "(s)" following a noun means the singular and plural forms of that noun.

As used herein the term "comprising" or "comprises" means consists only of or includes.

Preferably said first component includes a tear strip or other frangible feature whereby the overcap can be separated from the skirt thereby to allow access to that part of said nozzle component hitherto presenting to said closed space.

Optionally, in the dispensing condition, the nozzle component is to be or is above a disc seal of the mouth of a container to which it is associated.

Preferably, the assembly prior to fitting to a said container is in the dispensing condition, as a disc seal for a container for which the assembly is adapted is carried below the nozzle component and the second component within the first component.

Preferably an interference fit with the first component provides peripheral releasable retention of the disc seal.

Preferably a lower axial seal of the second component provides or can provide an annular seal on said disc seal.

Preferably, once separated from at least the skirt, the overcap is adapted to engage with said second component or skirt.

Preferably said overcap is adapted to engage with the second component whereby the second component and the nozzle component, when in the dispensing condition, define together with the overcap a fully enclosed space about part of said nozzle component.

Preferably the skirt has a shoulder peripherally overlapping as a hold down a complementary shoulder of the second component.

Preferably the first component unitary moulding defines a tamper evident collar ("tamper band") dependent from said skirt and/or as an extension of the skirt.

In another aspect the invention is a capping assembly engageable with or engaged with a necked container, said assembly being or having a first component in the form of a unitary moulding adapted to define a detachable overcap and at least a skirt, the skirt being adapted to engage or engaging from above the exterior of the neck of a suitable said container, a second component located within said first component from below, a disc seal member located within said first component below said second component, and a nozzle component carried through the second component yet moveable relative to the second component such that, in one relative condition (the "non-dispensing condition"), the nozzle component together with the surrounding second component, is adapted to provide closure of the mouth of a suitable said container or provides closure of the container, and in another condition ("the dispensing condition") of the nozzle component relative to the second component, is adapted to provide for such a suitable said container, or provides for the container, a liquid egress passageway, and wherein the second component and the nozzle component, when in or notionally considered in the non-dispensing condition, actually or notionally define together with the first component a fully enclosed space about part of said nozzle component, and wherein the second component and the nozzle component, when in or notionally considered in the dispensing condition or some other condition, together with the disc seal member and the first component actually or notionally fully enclose the nozzle component.

Preferably the detachable overcap after separation from the skirt can engage retainably the second component thereby, when the nozzle component and the second component are in the non-dispensing condition, to provide a closed space about the upper part of the nozzle component.

Preferably the nozzle component shuttles only between limits of movement corresponding to the dispensing and non-dispensing conditions. Alternatively, said nozzle component and the second component has a said other condition beyond the shuttling limits of movement of the nozzle component between the dispensing and non-dispensing conditions.

In another aspect the present invention consists in a container closed by a capping assembly of the present invention wherein the disc seal member interposed between said second component and the container provides a closed space about all of that part of said first component within which said nozzle component is disposed.

Preferably said nozzle component with respect to said second component is in either a dispensing condition or some other condition that does not equate to the same condition as said non-dispensing condition, the dispensing and non-dispensing conditions being those conditions between which the nozzle component is adapted to shuttle.

In another aspect the present invention consists in a closured container assembly containing a liquid, said assembly comprising or including a container with the liquid, the container having a neck with an open mouth, a seal member over and sealing the open mouth, and a closure assembly engaged to the container about the neck and extending over the seal member sealed mouth, wherein the closure assembly is defined by (i) a first moulding providing (a) an overcap, (b) a frangibly removable region or frangible connection ("frangible region") connecting to a lower periphery of the overcap, (c) an internally threaded skirt connecting to the overcap via the frangible region, and (d) (optionally) a tamper evident collar (e.g. "tamper band") severable from the internally threaded skirt, (ii) an outlet component ("nozzle component"), and (iii) an insert component to hold the nozzle component so that it can be manually shuffled between a dispensing and non-dispensing condition relative thereto, said insert component (I) releasably retaining a or the lower periphery of the overcap, and (II) peripherally sealing internally of the first moulding below the frangible region and above the internally threaded region of the skirt, and wherein when the seal member is no longer sealing the open mouth (whether through removal or rupture), in one condition (the dispensing condition), the nozzle component and insert component allows liquid egress and, in a second condition (the non-dispensing condition), the nozzle component and insert component allows at least substantially no liquid egress.

Preferably the liquid egress is first between part of the nozzle component and the insert and thereafter, after entry into at least one inlet in the nozzle out of an outlet of the nozzle.

Preferably the tamper evident collar is present and preferably it severs from the internally threaded skirt upon any substantial attempt to unscrew the threaded skirt from the externally threaded neck of the container.

Preferably the seal member has been brought into juxtaposition prior to sealing the open mouth by having being carried by the first moulding, i.e.; preferably the first moulding (i) includes or has included the seal member.

Preferably provision is made for unscrewing the closure assembly from the container thereby to allow the peel removal of the seal member.

In other forms of the present invention some rupturing capability can be provided whereby the nozzle component itself can be used in moving between the dispensing condition to the non-dispensing condition that will allow the egress of liquid to rupture the sealing member.

Other forms of removal of the seal member however can be provided.

The present invention therefore includes the use of a closure assembly as previously defined with a container of a kind as previously defined thereby providing the potential of a closured container assembly as aforesaid.

In yet a further aspect the present invention consists in a method of closure of a container so as to provide a closured container assembly as aforesaid, said method including the steps of applying a closure assembly as aforesaid to the container after filling the container at least to a substantial extent with a liquid and prior to, during or subsequent to such application sealing the seal member to the mouth of the container.

Preferably the sealing is by induction welding. It can instead as another preferred embodiment involve the use of adhesive.

In another aspect the present invention consists in a closured container assembly containing or to contain a liquid, said assembly comprising or including a container with the liquid, the container having an externally threaded neck with an open mouth, and a closure assembly screw engaged to the container about the neck and extending over the mouth, wherein the closure assembly is defined by (iv) a first moulding providing (a) an overcap, (b) a frangible region connecting to a lower periphery of the overcap, (c) an internally threaded skirt connecting to the overcap via the frangible region, and (d) (optionally) a tamper evident collar severable from the internally threaded skirt, (v) a nozzle component, and (vi) an insert component to hold the nozzle component so that it can be manually shuttled between (at least) a dispensing and non-dispensing condition relative thereto, said insert component (I) releasably retaining a or the lower periphery of the overcap, and (II) peripherally sealing internally of the first moulding below the frangible region and above the internally threaded region of the skirt, and wherein in one condition (the dispensing condition), the nozzle component and insert component allows liquid egress and, in a second condition (the non-dispensing condition), the nozzle component and insert component allows at least substantially no liquid egress.

In another aspect the present invention consists in an assembly engageable with an externally threaded necked container, said assembly having (at least)

an overcap defining moulding having an extended skirt with an internal thread adapted to screw engage the external thread of a suitable said container, an insert component retained or retainable by an array of splines, an array of splines of the overcap defining moulding, or the overcap defining moulding, and an outlet nozzle component carried by the insert component and movable relative thereto between at least two conditions, and (optionally) a seal member for the mouth of an appropriate complementary said container, wherein the overcap defining moulding, insert component, nozzle component are preassembled or associated such that at least part of the nozzle component and at least some (preferably most or all) of the insert component is in a substantially enclosed space between part of the overcap defining moulding and the seal member yet the internal thread of the skirt can screw engage the external-thread of an appropriate complementary said container to have its mouth sealed by the seal member, and wherein the overcap defining moulding defines an overcap frangibly detachable in a region of its skirt in a tamper evident manner from at least the insert component retaining region and the internally threaded region of its skirt, and wherein, when so fitted to an appropriate said container, the overcap can be removed in a tamper evident manner thereby enabling the nozzle component to be moved relative to the insert component to thereafter be capable of being shuttled between dispensing and non-dispensing conditions.

Preferably the overcap defining member is moulded in a plastics material.

Preferably a circular periphery of the insert component engages in a press or tight fit, welded, glued, or other manner with the interior of the overcap defining moulding.

Preferably that engagement for the purpose of retaining the insert component within the overcap prior to engagement thereof with a said container.

Preferably a peripheral lower region of the overcap part of the overcap defining moulding itself is engageable with a complementary part of the insert component such that after frangible detachment in a region of its skirt (in a tamper evident manner) the overcap can be removed therefrom and can, if desired, be replaced or relocated.

Preferably the means of frangible detachment includes a peripheral tear strip between the lower extremity of the overcap part of the overcap defining moulding and that part of the skirt (whether as a unitary part or otherwise) of the skirt. Alternatively the frangible detachment can be by twisting off or squeezing off of the overcap.

Preferably the overcap defining moulding includes as a lower most extension of its skirt a collar defining region adapted to be frangibly detachable as a tamper evident collar or tamper band from that region of the skirt with the internal thread such that should there be unauthorised loosening of the assembly from an appropriate container there is a tamper evident separation of at least of the collar or tamper band from the remainder of the skirt.

In another aspect the present invention consists in an assembly engageable with or engaged with a necked container, said assembly having an overcap defining moulding having an extended skirt with an internal means adapted to engage or engaging the exterior of the neck of a suitable said container, an insert component retained or retainable by an array of splines and/or the overcap defining moulding, and an outlet nozzle component carried by the insert component and movable relative thereto between at least two conditions one of which effects a seal with the insert component to effect closure of a liquid passageway, and (optionally) a seal member for an otherwise open mouth of or of a said necked container carried in or having been carried in the overcap and/or insert component.

In a further aspect the present invention consists in a method of providing a liquid dispensing assembly having a container and a closure assembly with an overcap feature for a nozzle component, said method comprising or including filling said container having an externally threaded neck with a liquid, and engaging with the external thread of the container a preassembled closure assembly to effect closure, the closure assembly having the following features:

(vii) a first moulding providing (a) an overcap, (b) a frangible region (c) an internally threaded skirt connecting to the overcap by the frangible region, and (d) (optionally) a tamper evident collar dependent from the internally threaded skirt, (viii) a nozzle component, and (ix) an insert component to hold the nozzle component so that it can be manually shuttled between a dispensing and non-dispensing condition relative thereto, said insert component (I) being capable of releasably retaining a or the lower periphery of the overcap, and (II) peripherally sealing internally of the first moulding below the frangible region and above the internally threaded region of the skirt, wherein optionally said tamper evident collar engages with complementary engagement means of the container such that should thereafter, the assembly be unscrewed such collar will be retained or will rupture at least in part from the skirt, and wherein in a tamper evident way the overcap can be released reliant on the frangible region.

Preferably the preassembled closure assembly includes a seal member adapted to be juxtaposed over an open mouth of the container.

Preferably said seal member seals to the container as a result of a welding or like procedure.

Preferably said insert component in any of the forms of the present invention seals to the overcap defining moulding reliant upon one or more of a press or tight fit, a shoulder retention, adhesive fixing, and a suitable welding (e.g. induction, friction, ultrasonic, etc.).

In another aspect the invention is a closured container assembly comprising or including a necked container closed by a capping assembly as previously defined.

A capping assembly, closure assembly or closed container assembly substantially as herein described with reference to any one or more of the accompanying drawings.

In another aspect the present invention consists in a one piece overcap moulding having an overcap region, a internally threaded skirt region, and a frangible link between the overcap and the threaded skirt region, and (optionally) a tamper evident tamper band dependent from the threaded skirt region, wherein there is no perforation in the overcap region, the threaded skirt region nor the frangible link.

In another aspect the present invention consists in a one piece overcap moulding of or for a drink dispensing container (eg bottle) having an overcap region, a internally threaded skirt region, and a frangible link between the overcap and the threaded skirt region, and (optionally) a tamper evident tamper band dependent from the threaded skirt region wherein where there is or is to be a fluid tight seal between the overcap and other closure assembly component(s) of and/or of the container itself, at least the overcap region and its frangible link to the internally threaded skirt region is or will be fluid tight.

Preferably the frangible link is a band that completely circumvents or substantially completely circumvents below the bottom periphery of the overcap region (i.e. if it only substantially circumvents there may for the rest of the periphery be a simple frangible connection between the overcap region and part of the internally threaded skirt region).

Preferably the bottom periphery of the overcap region internally includes a bead, lip, shoulder or the like adapted to act as a retention feature. In less preferred forms it can be a channel form to coact with a complementary bead, lip or the like that is carried by a separate component.

In still a further aspect the present invention consists in a closed container which includes a one piece overcap moulding in accordance with any form of the present invention providing protection for a dispensing nozzle of drink container, e.g. bottle.

In still a further aspect the present invention consists in a one piece overcap moulding having one or more or all of the features substantially as hereinafter described with reference to any one or more of the accompanying drawings.

In another aspect the invention is a capping assembly engageable with a necked container, said assembly being or having a first component in the form of a unitary moulding adapted to define a detachable overcap and at least a skirt, the skirt being threaded to engage the exterior of the neck of a suitable said container, a second component located within said first component, a nozzle component carried through the second component yet moveable relative to the second component such that, in one relative condition, the nozzle component together with the surrounding second component, is adapted to provide no liquid egress passageway (the "non-dispensing condition"), and in another condition of the nozzle component relative to the second component, is adapted to provide a liquid egress passageway (the "dispensing condition"), a seal member carried within the first component which provides at least substantial closure of the passageway, wherein the second component and the nozzle component, when in the dispensing condition, define or could define together with the first component a fully enclosed space about part of said nozzle component, and wherein said nozzle component is or can be wholly to one side of the seal member (eg when the nozzle component and second component are in the dispensing condition).

Persons skilled in the art will appreciate the other aspects of the present invention within the scope of the present invention. These include commodities of commerce being such filled containers. Other uses include the recycling of such containers for casual use by a purchaser of it in an original form.

BRIEF DESCRIPTION OF THE DRAWINGS

Preferred forms will now be described with reference to the accompanying drawings in which.

DETAILED DESCRIPTION OF THE INVENTION

In the preferred form of the present invention the seal member can be of any of the conventional types used with or without welding to the top of the mouth of a container. It can be provided with a tang, tab or the like to allow its easy peel removal in whole or in part once the cap assembly has been disengaged (albeit while leaving the tamper band behind). In other forms, if desired, a seal piercing provision can be provided to the nozzle component such that it has the ability to rupture any seal member (whether polycell, foil, plastics, or otherwise) closing the top of a mouthed container.

Figure 5:
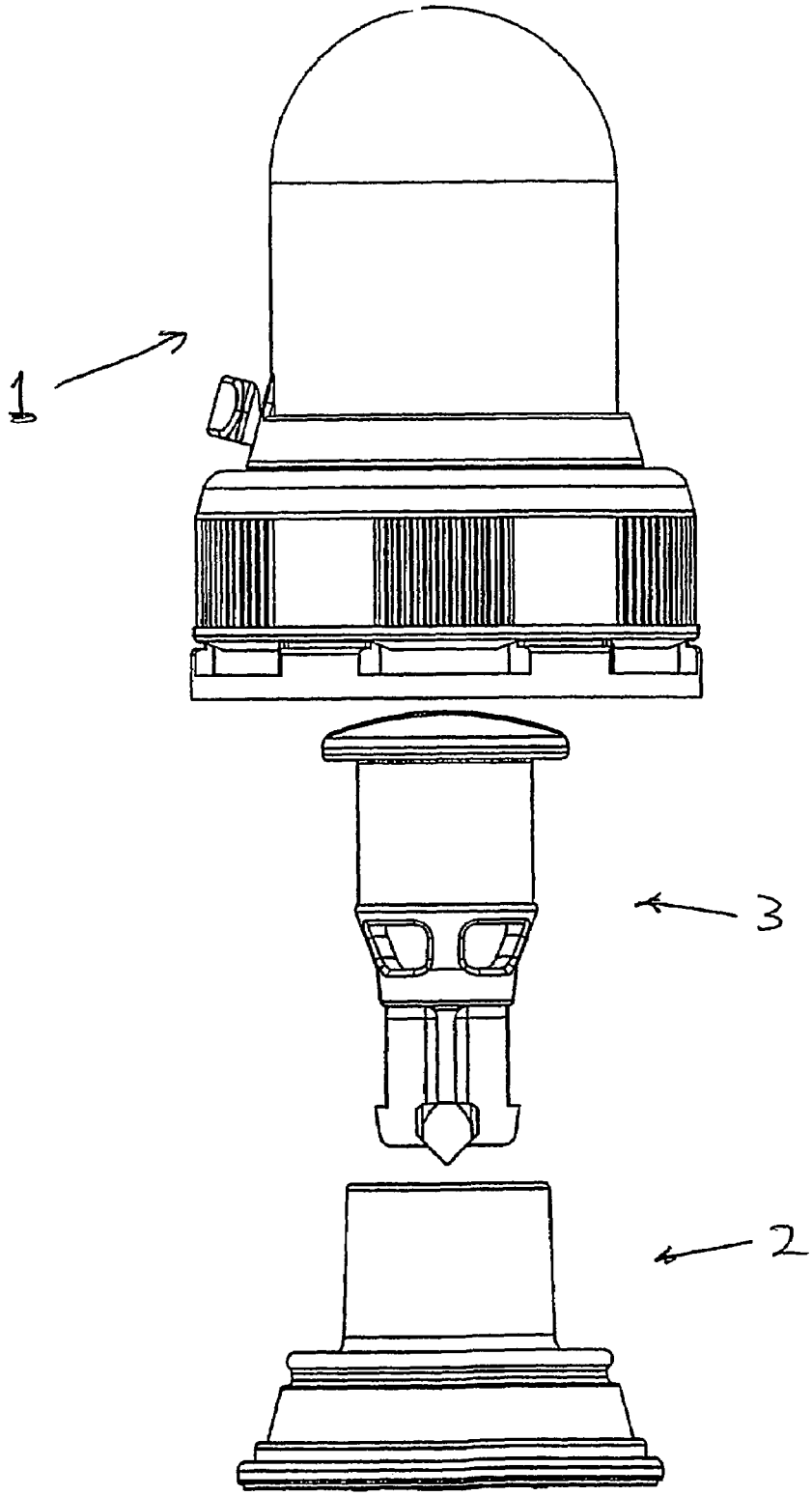
FIG. 5 is an exploded view that shows the three preferred components each provided as a moulding (preferably the assembly also being provided with a disc sealing member), showing how the nozzle outlet moulding can be inserted down into the insert moulding to the condition as shown in FIGS. 1 and 2 prior to association of the insert carrying the nozzle component within the one piece overcap moulding.
Figure 6:
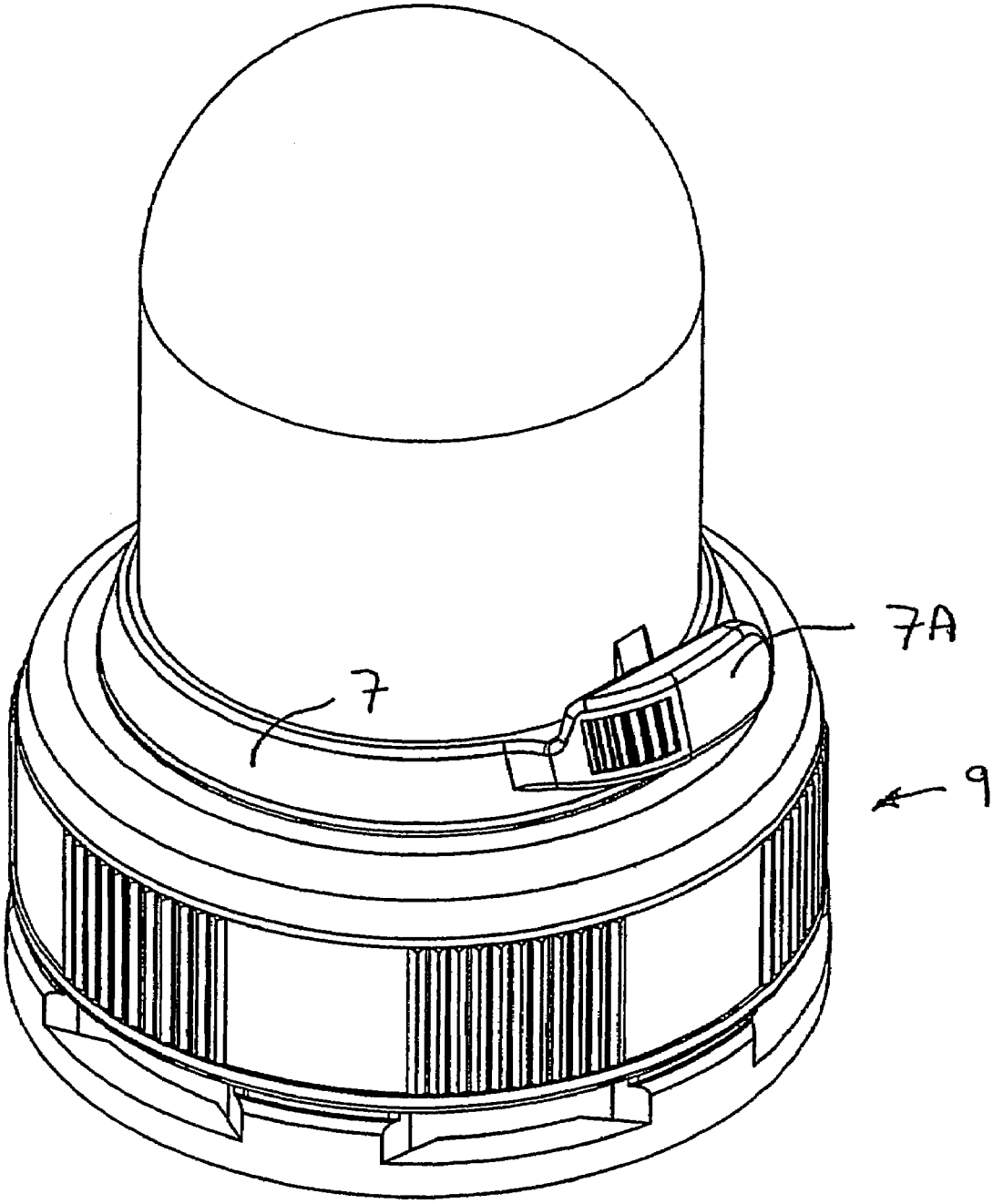
FIG. 6 is a perspective view from the outside of a one piece overcap defining moulding in accordance with the present invention, there being shown a tag adapted to be gripped to allow the removal of the frangible link as a band around the lower periphery of the overcap between the overcap and the skirt, FIG. 6 also showing how a tamper band is preferably integrally provided at the bottom of the knurled or otherwise grip enhanced periphery of the internally threaded skirt.
Figure 7:
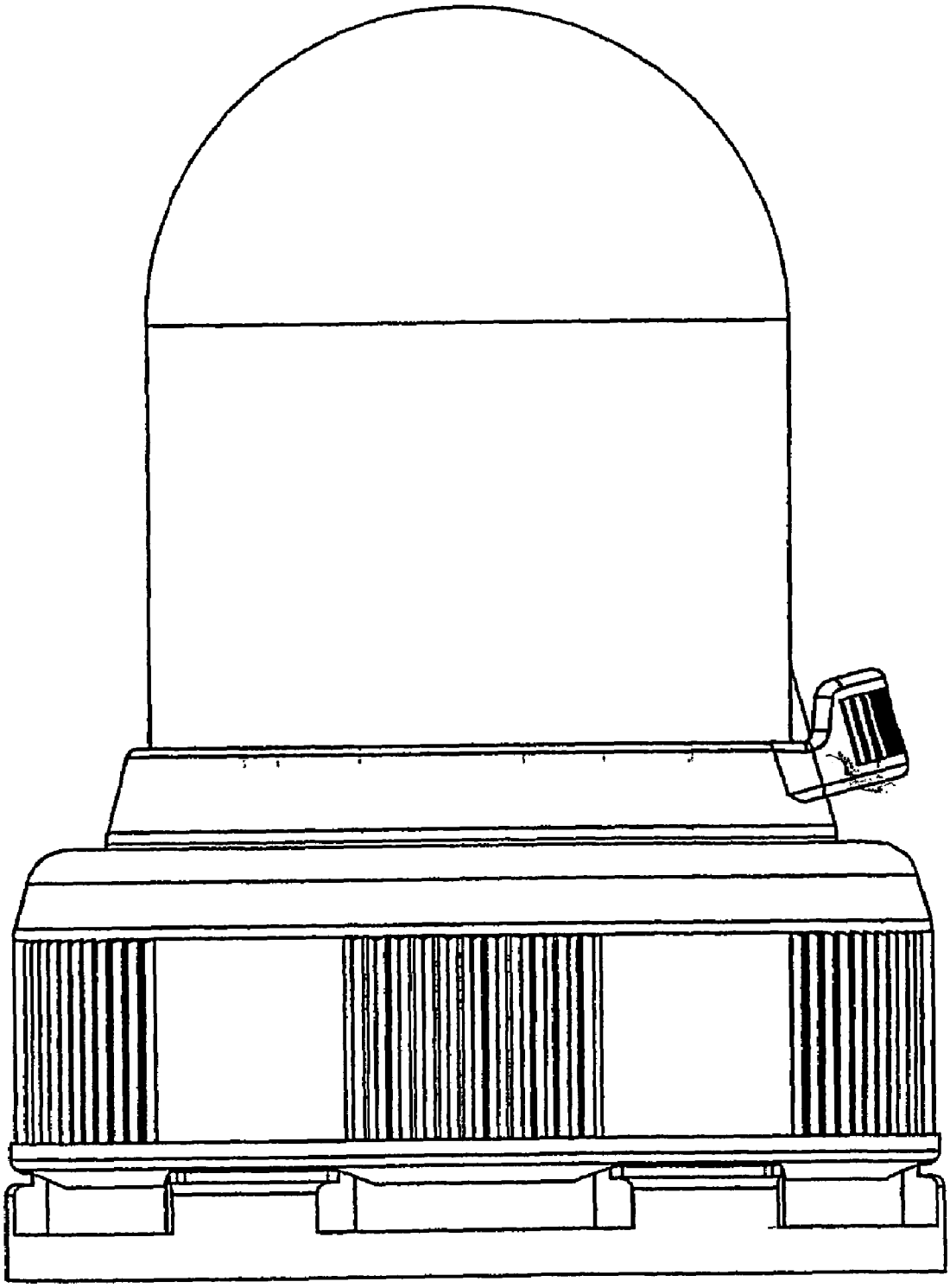
FIG. 7 is a side elevation of the moulding as shown in FIG. 6.
Figure 8:
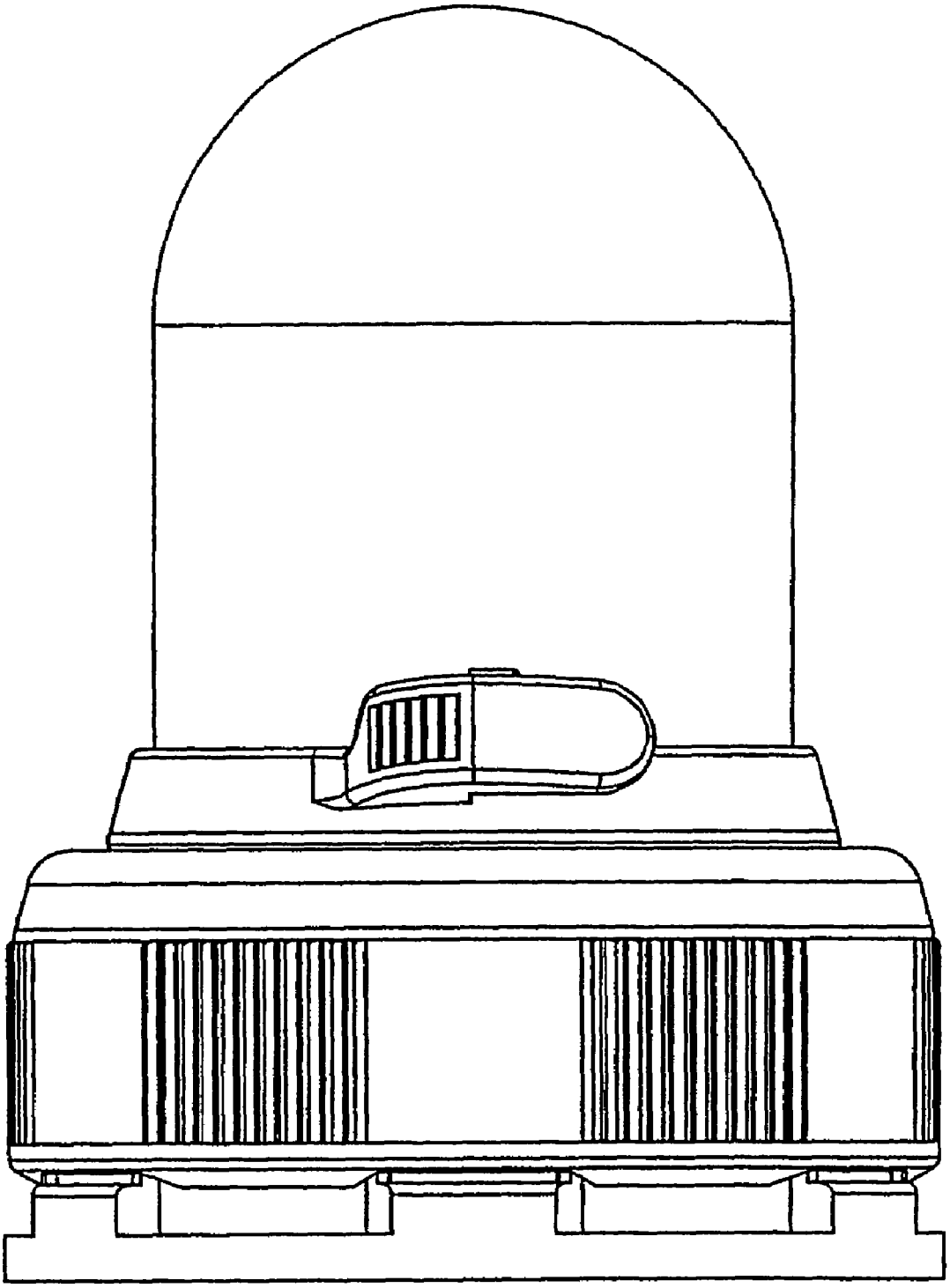
FIG. 8 is a further elevation of the moulding shown in FIGS. 6 and 7.

In the preferred form of the present invention each of the components is of polyethylene or polypropylene. As can be seen in FIG. 5 there are three main moulded components namely, the overcap defining moulding 1, the insert 2 (itself a moulding), and the nozzle component 3 (again preferably a moulding). Not shown in FIG. 3 is a standard or more or less standard polycell or other type disc seal 17 to be carried in a manner hereinafter described.

Figure 2:
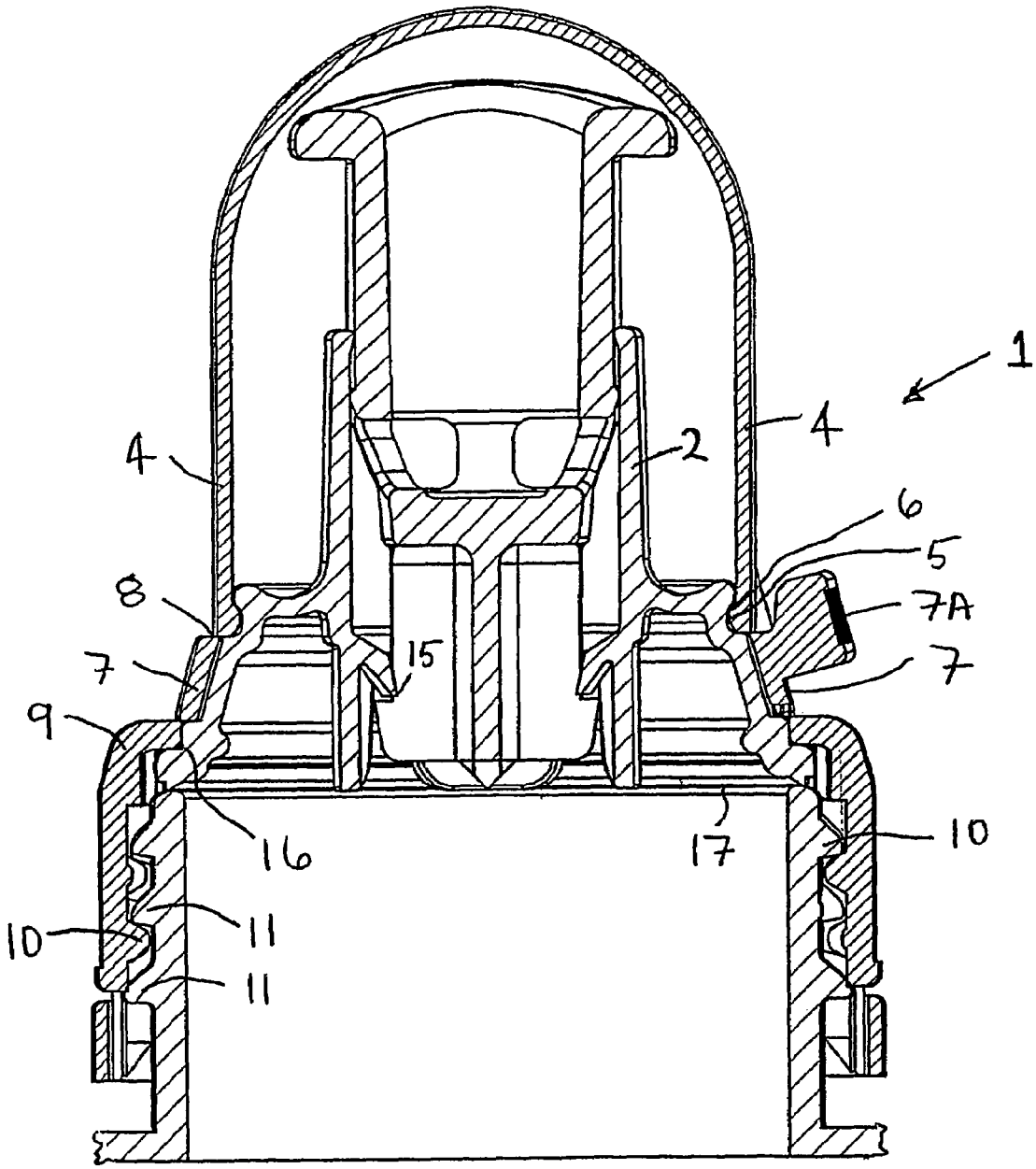
FIG. 2 is a similar view of the arrangement shown in FIG. 1, both FIGS. 1 and 2 showing the nozzle component in a condition relative to the insert component as applied to a container in a hot fill line, FIG. 2 however showing the sealing member as lowered onto and preferably induction welded through the overcap moulding to the mouth regions of a suitable complementary container shown in part.

As can be seen in FIG. 2, in the preferred form of the present invention the component 1 includes an overcap 4 with a retention shoulder or bead 5 adapted to underlie a retention shoulder 6 of the insert 2. This provision is to allow the removal and replacement of the overcap 4 as and when required after removal of the band 7 under the action of the pull tab 7A which likewise is part of said frangible region. As can be seen this region 7 connects frangibly a bottom peripheral region 8 of the overcap 4 through to a frangibly connected peripheral skirt 9 with its internal thread 10 to engage the external thread 11 of a neck of a suitable container.

Figure 1:
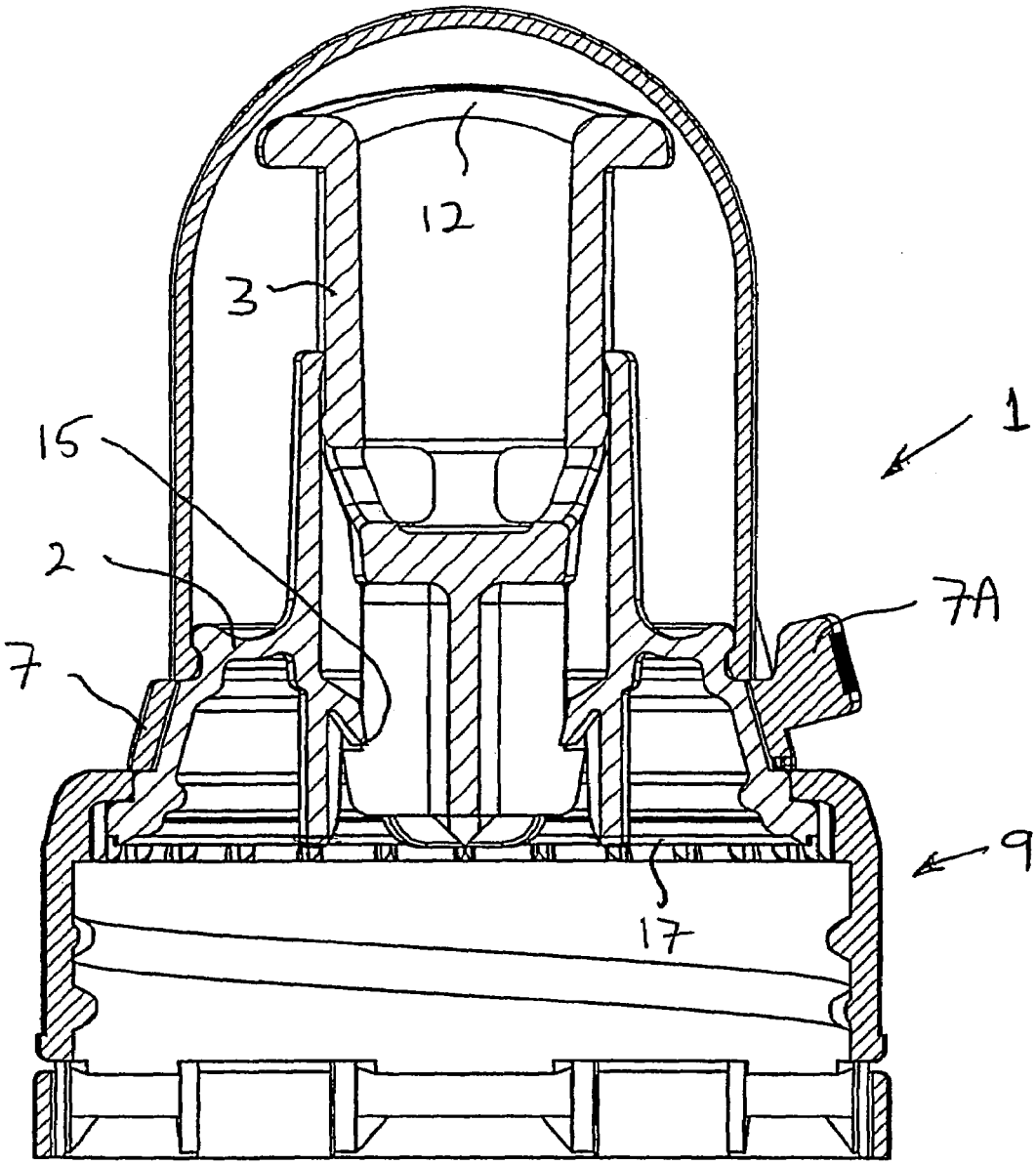
FIG. 1 shows a closure assembly of an embodiment in accordance with the present invention in section from one elevation, there being shown also a sealing member carried by the one piece overcap internally of its skirt.

In the condition shown in FIG. 2, and for that matter FIG. 1, the nozzle component 3 is in its preferred as supplied condition. In the condition shown in FIGS. 1 and 2 the nozzle component 3 is retained against removal by the interaction at 15. It is this, as supplied, condition with that component 3 above the disc seal 17 carried by the region 9 internally thereof, that would be supplied to a hot line user of the overall assembly and would still be the relative condition between the nozzle component 3 and the insert 2 when on sold together with a sealed liquid containing bottle (of any appropriate shape) but with complementary features for engagement with the internal thread of the skirt 9.

Figure 3:
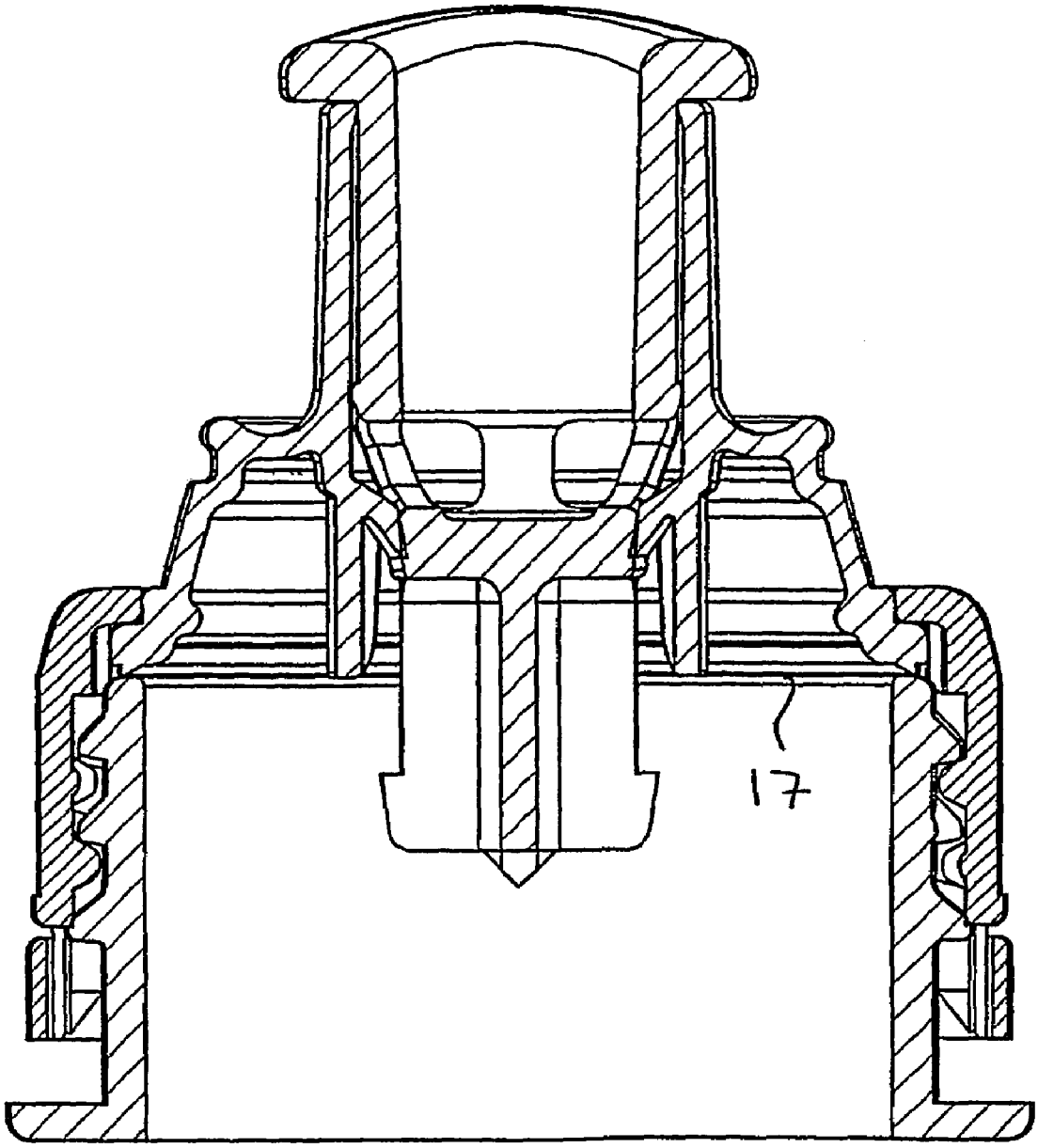
FIG. 3 is a similar view to that of FIG. 2 but showing the nozzle assembly moved downwardly relative to the insert component (as would only in use occur after removal of the overcap after removal of the frangible link or band), the relative position between the nozzle component and the insert component as shown in FIG. 3 being a non-dispensing condition which seals between the two reliant upon what otherwise are retention shoulders as described with respect to the purchased condition of FIG. 2.

The insert 3 however is movable relative to the insert 2 through and/or to at least two conditions, one of which is shown in FIG. 3 being a condition that pierces the foil and which also is the non-dispensing condition (see FIG. 10) at which stage, if desired, the overcap can be replaced after having previously having been removed after the removal of the band 7.

Figure 9:
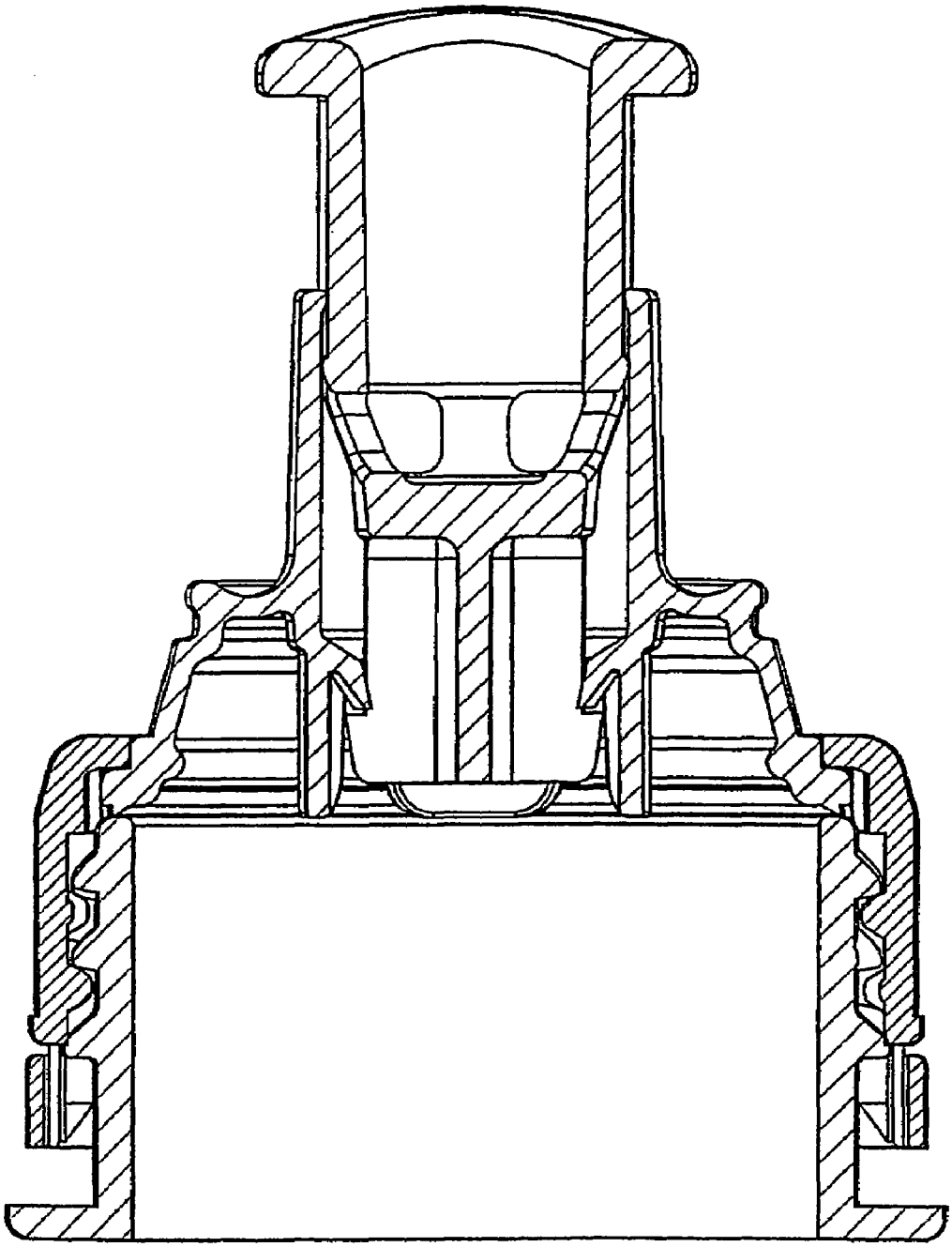
FIG. 9 shows the assembly as in FIG. 4 or some approximation thereto in the dispensing condition, (c.f. the non-dispensing condition of FIGS. 3, 26 and 27)
Figure 10:
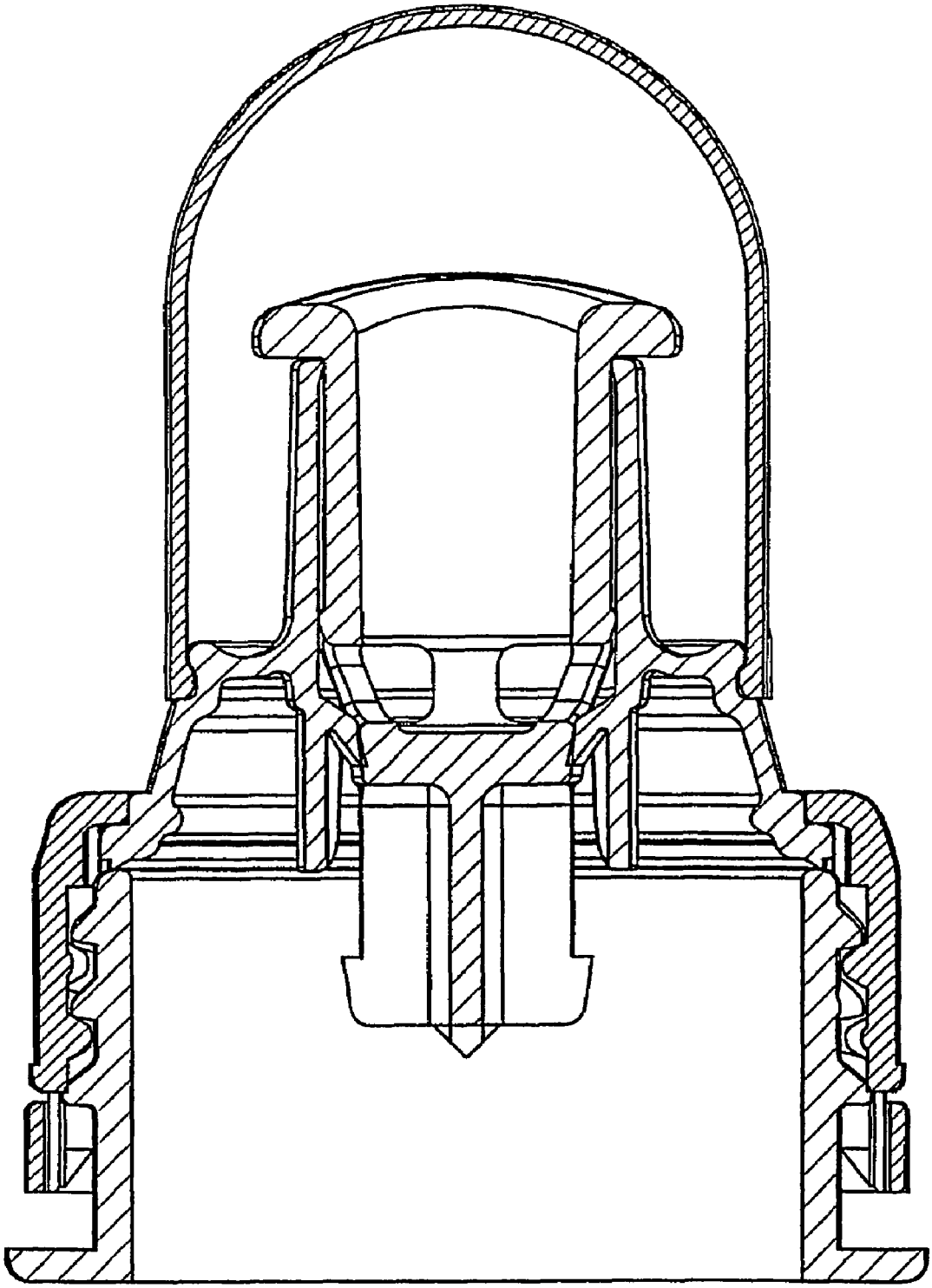
FIG. 10 is a similar view to that of FIG. 3 but with the nozzle component relative to the insert component in its non-dispensing condition that seals against liquid egress and with the overcap replaced.
Figure 11:
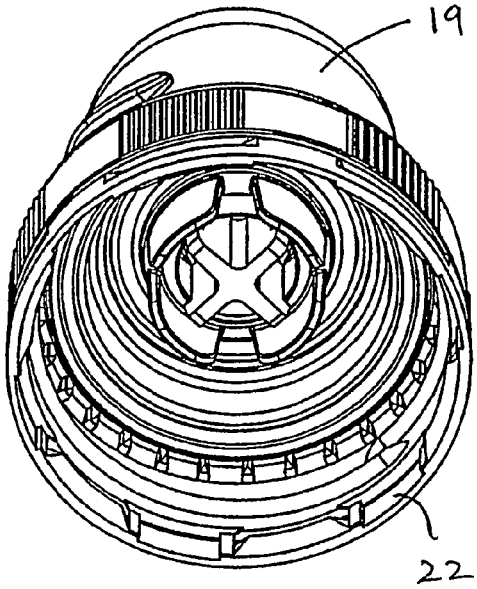
FIG. 11 shows prior to fitment to a threaded container, a capping or closure assembly of the present invention without a disc seal when viewed in perspective from below.
Figure 12:
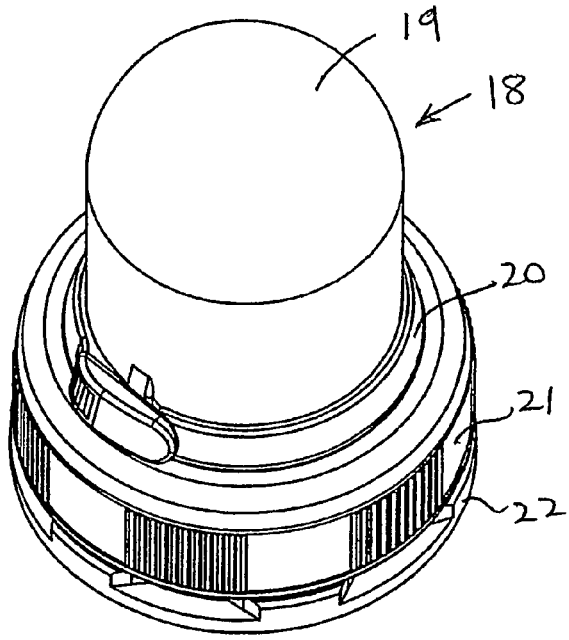
FIG. 12 is the same assembly as shown in FIG. 11 but shown in perspective from above.
Figure 13:
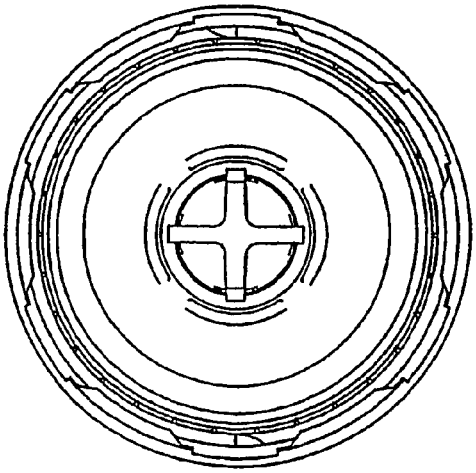
FIG. 13 is a view in plan from below of the assembly of FIGS. 11 and 12.
Figure 14:
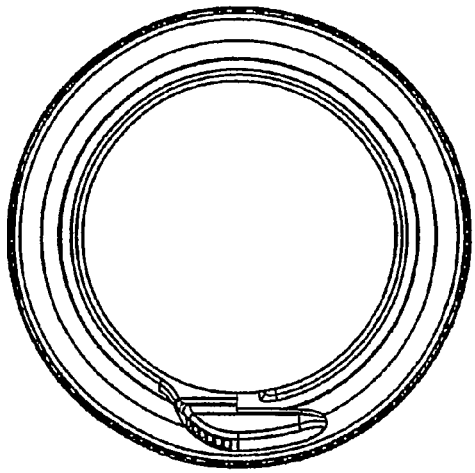
FIG. 14 is a view from above in plan of the assembly shown in FIGS. 11 to 13.
Figure 15:
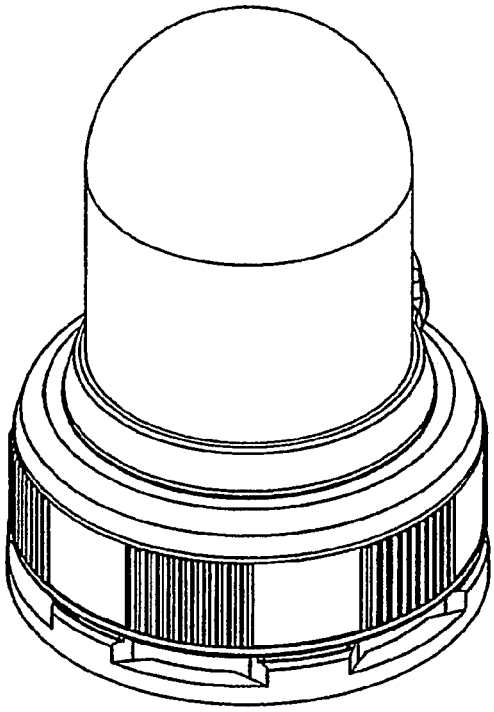
FIG. 15 is a similar view to that of FIG. 12 but with the assembly rotated by 180°.
Figure 16:
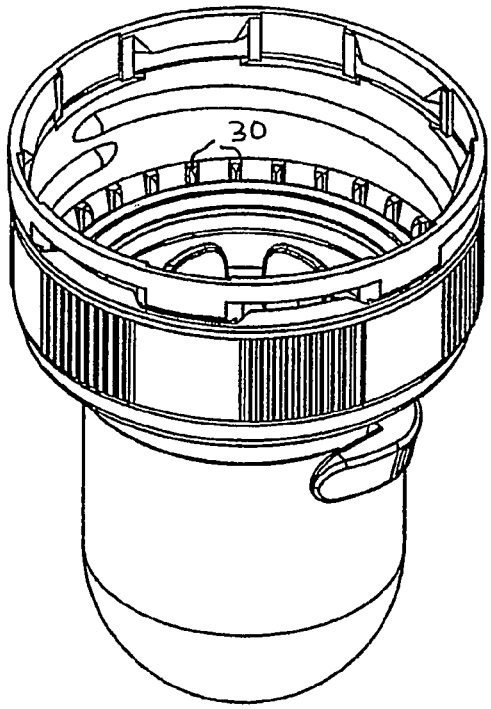
FIG. 16 shows the assembly of FIGS. 11 to 15 in perspective when viewed inverted so as to see it from below.
Figure 17:
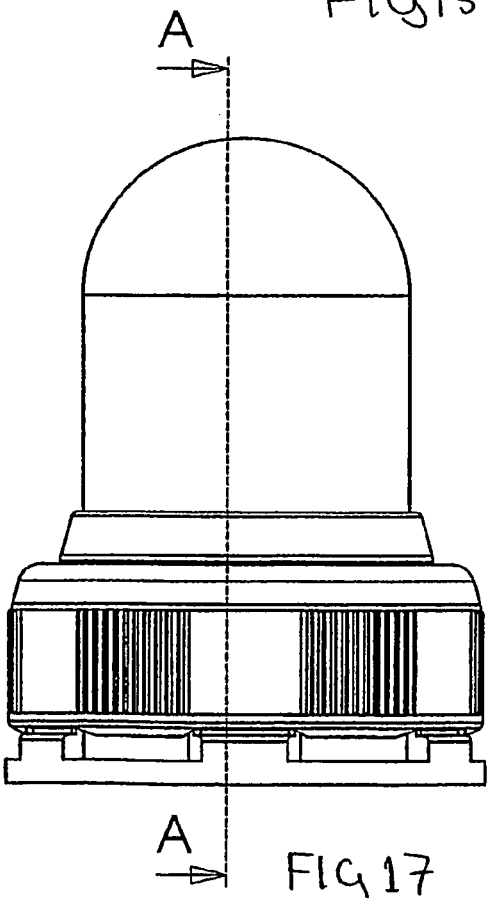
FIG. 17 is a side elevation of the assembly of FIGS. 11 through 16.

In use, the outlet 12 of the component 3 only allows outflow of liquid as shown in FIG. 9 and this requires the region 18 of the nozzle component to be clear of the retention shoulder 14 (preferably the lower region of a frustoconical flange). In the condition as shown in FIGS. 3 and 10 there is a liquid tight abutment occurring between 14 and 15.

Providing a seal in all assembled conditions is the interface 16 between the threaded skirt 9 of the moulding 1 and the insert 2. This can be achieved in any appropriate way including friction welding, induction welding or the like.

It is envisaged that an assembly in a condition as shown in FIG. 1 will be supplied to a bottler. This would include the disc seal member 17 appropriately positioned by a tight fit or other means within the interior of the skirt 9. Thereafter that product in hot fill conditions can then be directly screwed on to a complementary container and induction welding will allow the collapse and seal of the disc seal member 17 on to the open mouth of a container, i.e.; as in the condition shown in FIG. 2. This can be a consequence of induction or ultrasonic welding through the overcap moulding.

With the seal member as carried during such closure fitment and the substantially enclosed volume of much of the as supplied unit, little moisture or air to pool condensate is available to cause concern.

Once a bottle is purchased with the assembly closing the container in a condition as shown in FIG. 2 removal of the band 7 under the pulling action of the pull tab 7A allows the removal of the overcap 4 and thereafter the depression of the nozzle assembly to the condition as shown in FIG. 3. This can occur either without removal of the remainder of the closure assembly or not.

Figure 4:
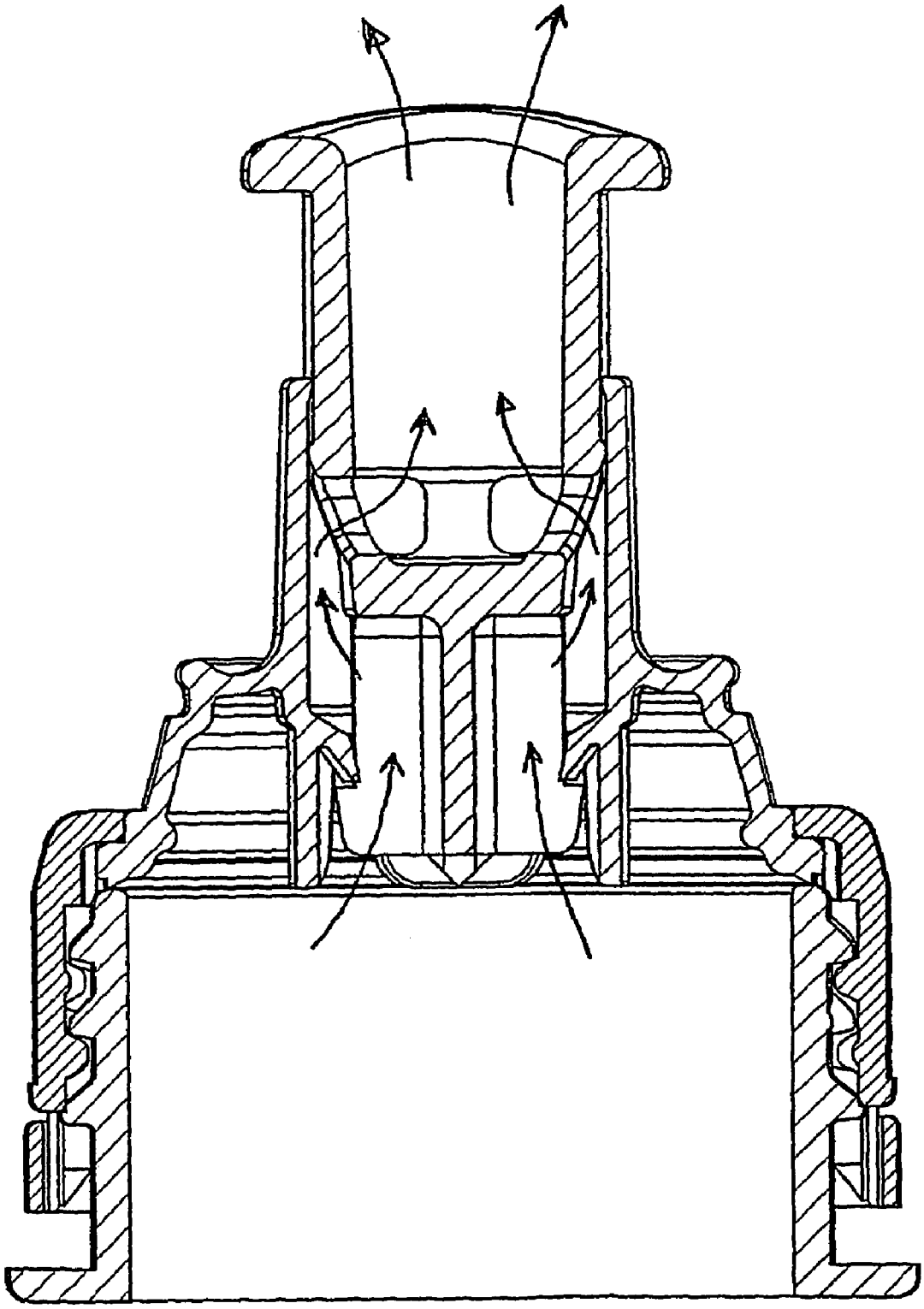
FIG. 4 is a similar view to that of FIG. 3 but showing the container in the dispensing condition, showing the overcap removed, etc.

If the seal member 17 is to be pulled free prior to the use of the closure assembly between the conditions shown in FIG. 3 (non-dispensing condition) and FIGS. 4 and 9 (the dispensing condition) unscrewing and thus evidence of tampering will ensue.

If however otherwise the nozzle component is simply pressed down from its as supplied condition as in FIGS. 1 and 2 to the condition as in FIG. 3 there will be rupturing of the seal 17.

The present invention is applicable to the assembly and the overcap defining moulding irrespective of whether or not there is to be piercing or peel removal.

In FIGS. 11 through 26 there is seen as the first component, the unitary moulding 18 which defines an overcap 19, the removable tear strip 20, the skirt 21 and the tamper band 22.

Figure 18:
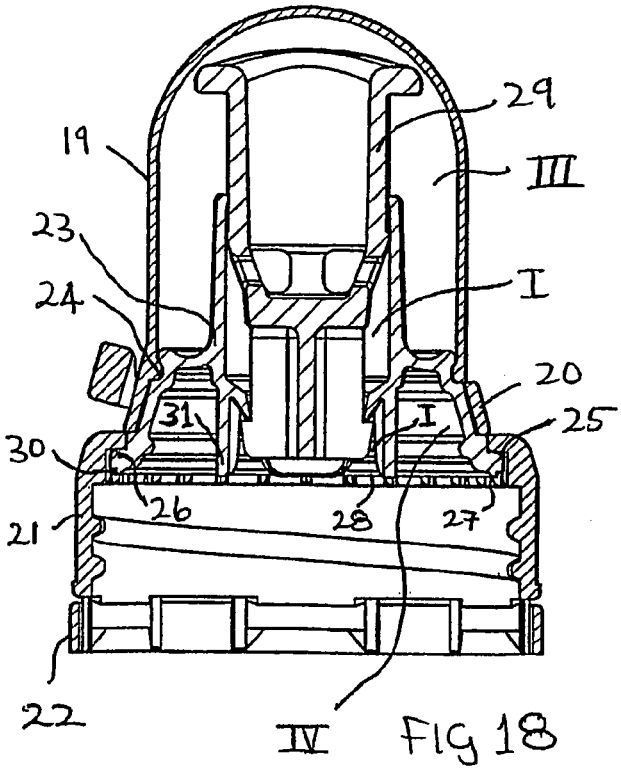
FIG. 18 is a section at AA of the assembly of FIG. 17 showing the presence of a disc member adapted to seal the mouth of a necked container to which it is to be fitted, said disc seal being carried by an interference fit seen in FIGS. 11 and 16, FIG. 18 also showing the liquid egress passageway defining condition of the nozzle component with respect to the second component such that a closed space would be defined about part of the nozzle component were the nozzle component (notionally owing to the disc member presence) to assume its non-dispensing condition, such space being defined by the first component (preferably at least primarily the overcap thereof), at least part of the second component and at least part of the nozzle component, and FIG. 18 also showing, with the fitment of the disc seal, a closed space "I" about the bottom part of the nozzle component in communication with the space "III"
Figure 19:
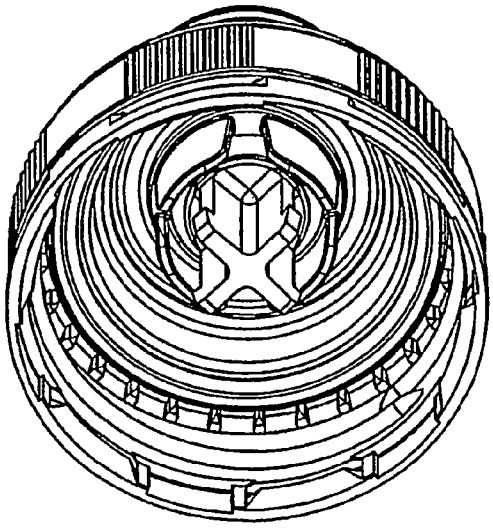
FIG. 19 is a similar view to that of FIG. 11 but after removal of the overcap and in the non-dispensing condition.
Figure 20:
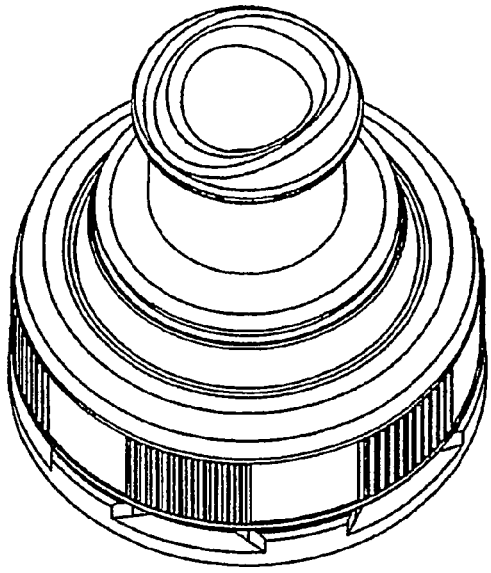
FIG. 20 is a similar view to that of FIG. 12 but after removal of the overcap by tear removal of the tear strip (i.e frangible means) of the first component and the lifting free of the overcap from the second component to which may or may not engage independently and in the non-dispensing condition.
Figure 21:
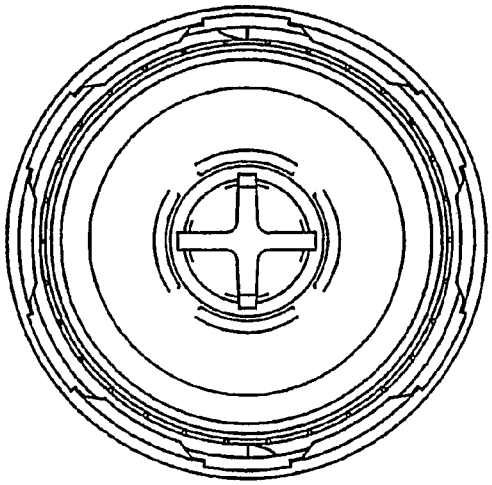
FIG. 21 is a similar view to that of FIG. 13.
Figure 22:
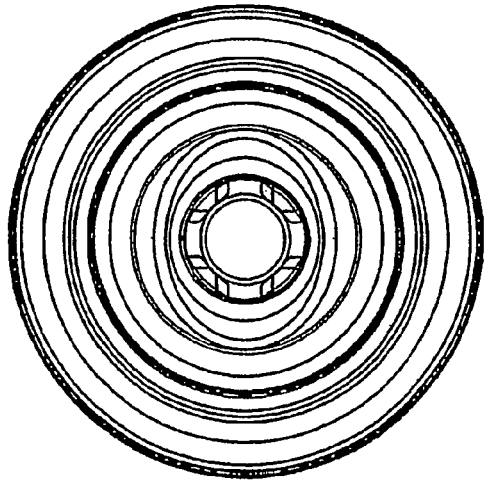
FIG. 22 is the plan view from above of the assembly of FIGS. 19 to 21.
Figure 23:
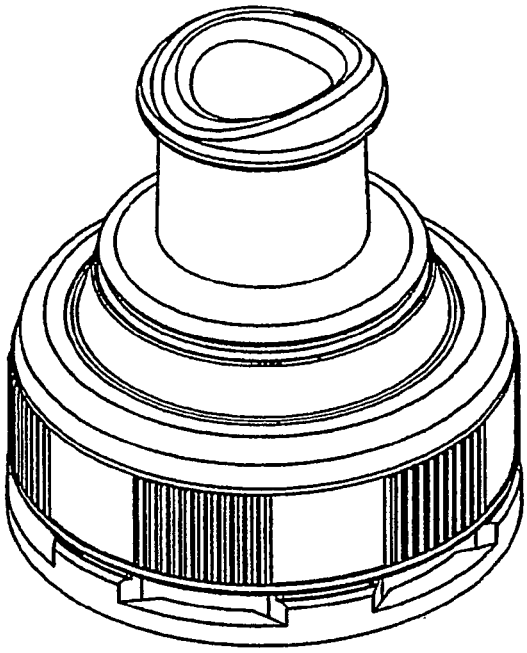
FIG. 23 is a perspective view from above of the assembly as in FIGS. 19 through 22.
Figure 24:
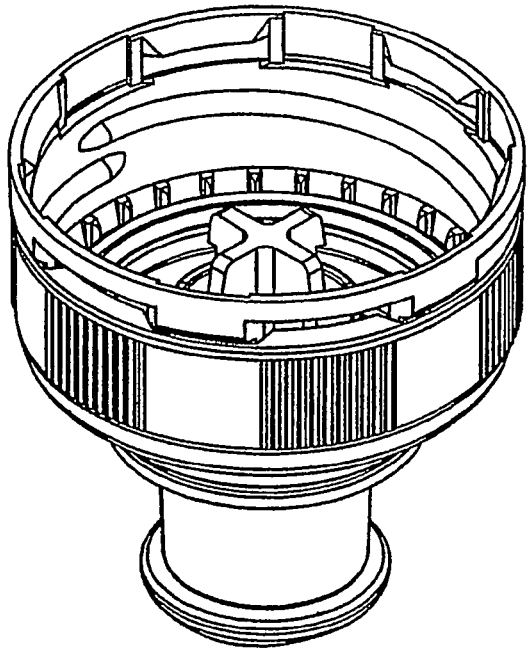
FIG. 24 shows inverted and from below in perspective, the assembly of FIGS. 19 through 23 showing the nozzle assembly fully depressed to its limit as allowed between itself and the second component or insert thereby to assume the non-dispensing condition.
Figure 25:
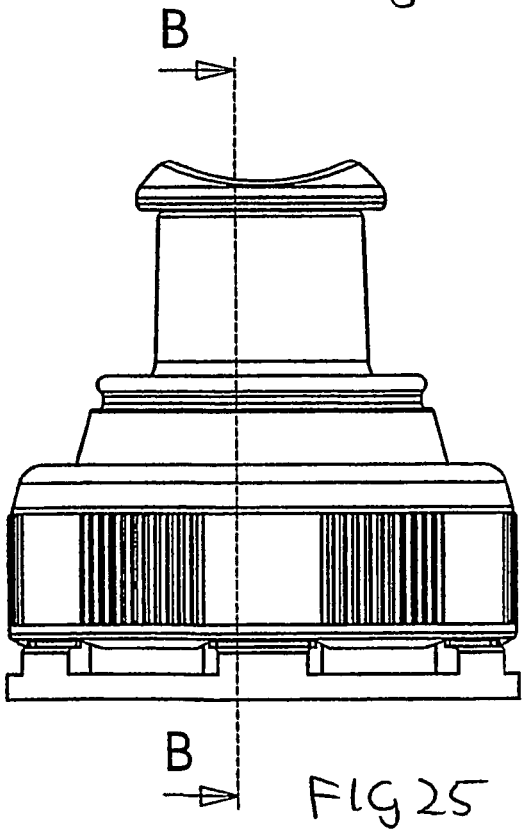
FIG. 25 is a side view of the arrangement of FIG. 24.

As best can be seen by reference to FIG. 18 the second component 23 locates in a peripheral groove in a manner an annular bead 24 of the overcap 19. This is to allow its removal from the second component or insert 23 when the tear strip 20 or its equivalent has been removed, ruptured or otherwise. Such removal still leaves the skirt 21 threadingly engaged with a container (not shown) when in use, the skirt 21 holding with its shoulder 25 the lower complementary shoulder 26 of the second member 23 against withdrawal. This if of importance since the crab claw like annular flange 27 will be held down on to the rim of a suitable container when the disc seal 28 has either been removed or been ruptured.

Figure 26:
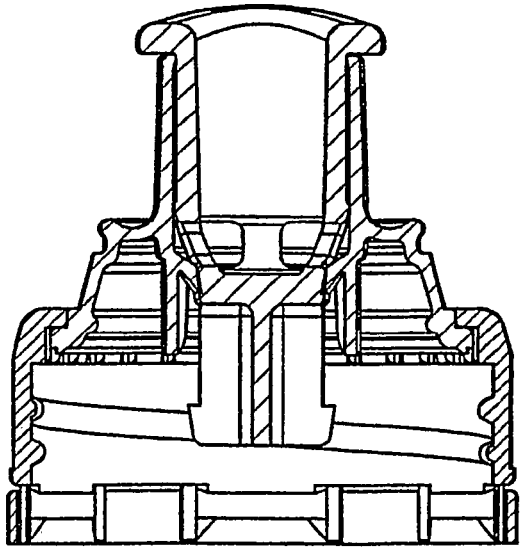
FIG. 26 is a section BB of the arrangement shown in FIG. 25.
Figure 27:
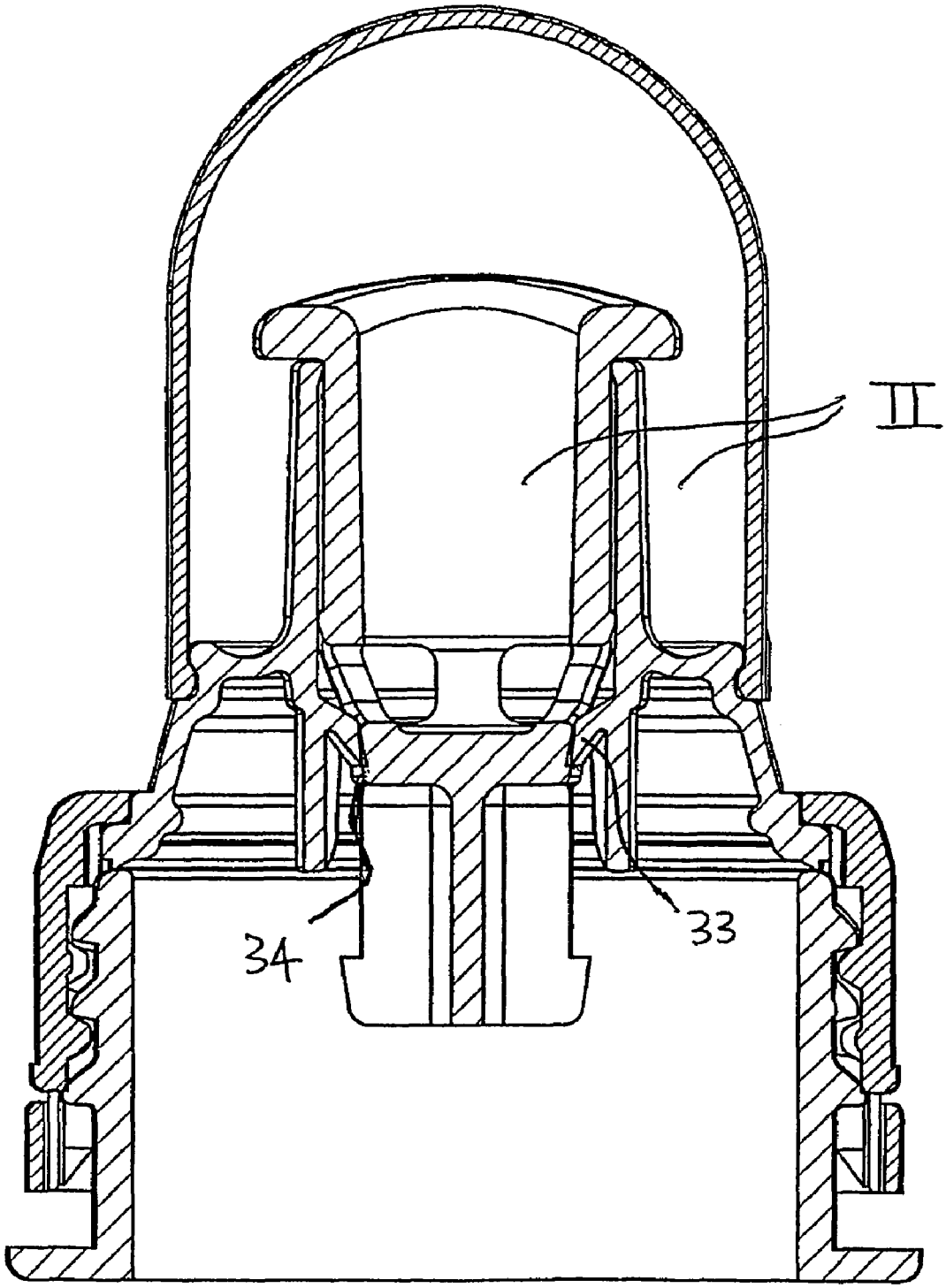
FIG. 27 shows the actual or notional closed space "II", when the overcap has been replaced and the nozzle component and second component or insert are in the non-dispensing condition.

In the condition shown as in FIG. 18 the nozzle component 29 relative to the second component 23 is in the dispensing condition, i.e. it defines a liquid egress passageway which is shown by the arrows in FIG. 26 provided the seal 28 (still being shown by a broken line in FIG. 26) has been removed or ruptured. Please note that either possibility can be employed for breaking the seal.

To be noted in FIG. 18 is the at least substantially closed zone (I) resulting from the presence of the disc seal 28 even precapping of a suitable container. This member, held preferably by the interference fit providing projections 30 at the periphery of the disc seal 28 (as shown in FIG. 18) ensures at least substantial contact with the annular inner skirt 31 of the second component 28.

This means that by the time product is in its form as in FIG. 18, notwithstanding the fact that the liquid egress passageway is in the dispensing condition (i.e. the nozzle component and the second component are in the dispensing condition), or could in some variant be in some other condition (i.e further raised beyond the normal shuttling limits if allowed by the flange 33 to skeletal shoulder 34 abutment), there is still a seal around the zone (III) provided by the inner moulding and there is no easy route of access into the space (I) (or its actual or notional residue) nor indeed even the peripheral space (IV) or its actual or notional residue.

Please note however it is still within the scope of the present invention were the nature of the nozzle component and the second component such that at the normal relative limits of movement, were there to be a closure condition thereby enclosing spaces, the liquid egress passageway could be defined by some intermediate relative condition. Most preferred however is the arrangement as depicted as a user need simply pull the nozzle 29 to the condition shown in FIG. 18 once the sealing disc 28 has been removed from the container to which it will have been preferably high frequency induction welded after fitment of the assembly as in FIG. 18 to such a container. Of course in order to remove the assembly or at least the majority of the assembly as shown, the tamper band 32 will be broken free from the skirt 21 thereby evidencing tampering if unauthorised, and leaving behind for easy removal the disc seal 28 from the top of the container prior to re-engagement of the threaded skirt 21 to the container.

At any suitable time the tear off strip 20 can be pulled free thus allowing the over cap 19 to be removed and liquid to egress in the manner depicted by the arrows of the liquid passageway in FIG. 4 when the nozzle component is in the dispensing condition.

It can be seen therefore with the prospect of preassembly of the closure assembly together with a seal member there is the prospect that the enclosed regions of the closure assembly are not susceptible to the intrusion of the moisture and air at a hot fill line when liquids (at for example 80° C.) are dispensed into the containers prior to association with the seal member. This means therefore there is little water vapour beyond the ordinary available to condense within the enclosed space of the closure member itself. Also, with the closure assembly being capable of being coupled to the seal member itself (even if only a loose fit) and with little space having been confined by the seal member above itself when in non humid conditions, and no space below it once it has been sealed about the mouth of the container, there is little in the way of moisture and air being confined that can lead to condensation and thus water pooling on the seal member. This water pooling occurs in other conventional overcaps and sipper bodies where a vacuum is formed that pulls water through the mating faces of such conventional overcaps and sipper bodies.

Such pooling in the past has been considered undesirable owing to the impression it provides to a consumer and of course the prospect that it could be a pool supportive of bacteria.

It is believed that the present invention will therefore find widespread acceptance.

I claim:

1. A capping assembly engageable with or engaged with a necked container, said capping assembly comprising a first component in the form of a unitary moulding adapted to define a detachable overcap and at least a skirt, the skirt being adapted to engage or engaging an exterior of a neck of said container, a second component at least in part located within said first component, and a nozzle component carried through the second component yet moveable relative to the second component such that, in one relative condition, the non-dispensing condition, the nozzle component together with the surrounding second component, is adapted to provide closure of the mouth of said container or provides closure of the container, in another condition, the dispensing condition, of the nozzle component relative to the second component, is adapted to provide said container, or provides for the container, a liquid egress passageway, the second component and the nozzle component, when in the non-dispensing condition, define together with the first component a fully enclosed space about part of said nozzle component, said first component including a tear strip or other frangible feature whereby the detachable overcap is separated from the skirt thereby to allow access to a part of said nozzle component presenting to said fully enclosed space about part of said nozzle component.

2. The capping assembly of claim 1, wherein said skirt of the first component is internally threaded as the adaptation to engage or the means by which it is engaged with the exterior of the neck of said container.

3. The assembly of claim 1, wherein when not in the non-dispensing condition the nozzle component is above a disc seal of a mouth of the container.

4. The assembly of claim 1, wherein in the non-dispensing condition, the container is carried fully below the nozzle component and the second component within the first component.

5. The assembly as claimed in claim 1, wherein said detachable overcap, once separated from a remainder of the first component is adapted to engage with said second component or skirt.

6. The assembly of claim 5, wherein said overcap is adapted to engage with the second component whereby the second component and the nozzle component, when in the non-dispensing condition, define together with the overcap a fully enclosed space about part of said nozzle component.

7. The assembly of claim 1, wherein the skirt has a shoulder peripherally overlapping as a hold down of a complementary shoulder of the second component.

8. The assembly of claim 1 wherein the first component unitary moulding defines a tamper evident collar or a tamper band dependent from said skirt and/or as an extension of the skirt.

9. The closured container assembly comprising a necked container closed by a capping assembly of claim 1.

* * * * *